US005713064A

United States Patent [19]

Kasiske et al.

[11] Patent Number: 5,713,064

[45] Date of Patent: Jan. 27, 1998

[54] METHOD AND APPARATUS FOR FORMING TONER IMAGES WITH TWO DISTINCT TONERS

[75] Inventors: W. Charles Kasiske, Penfield; Edward M. Eck, Leroy; Garold F. Fritz, Webster, all of N.Y.

[73] Assignee: Eastman Kodak Company, Rochester, N.Y.

[21] Appl. No.: 583,731

[22] Filed: Jan. 17, 1996

[51] Int. Cl.[6] ..... G03G 21/00

[52] U.S. Cl. ..... 399/99; 399/71; 399/232; 399/264; 399/296

[58] Field of Search ..... 399/343, 98, 34, 399/71, 264, 99, 168, 169, 178, 231, 232, 296, 344, 129

[56] References Cited

U.S. PATENT DOCUMENTS

| | | | |
|---|---|---|---|
| 4,078,929 | 3/1978 | Gundlach | 96/1.2 |
| 4,116,555 | 9/1978 | Young et al. | 399/343 |
| 4,546,060 | 10/1985 | Miskinis et al. | 430/108 |
| 4,761,668 | 8/1988 | Parker et al. . | |
| 4,959,695 | 9/1990 | Nishimura et al. | 399/232 |
| 5,001,028 | 3/1991 | Mosehauer et al. | 430/45 |
| 5,045,893 | 9/1991 | Tabb . | |
| 5,049,949 | 9/1991 | Parker et al. . | |
| 5,208,636 | 5/1993 | Rees et al. . | |
| 5,241,356 | 8/1993 | Bray et al. . | |
| 5,258,820 | 11/1993 | Tabb . | |
| 5,409,791 | 4/1995 | Kaukeinen et al. | 430/54 |

*Primary Examiner*—Shuk Lee
*Attorney, Agent, or Firm*—Norman Rushefsky

[57] ABSTRACT

The scavenging of a first toner into a second toning station in a DAD-CAD or CAD-DAD process can be reduced by allowing scavenged toner to deposit in the background of single color images. The polarity of the first toner of the scavenged toner is not changed prior to transfer and remains on the image member through transfer from which it is later cleaned. Alternatively, scavenged toner is deposited from a second toning station on the image member while no images are being made and allowed to pass through transfer to be cleaned off.

8 Claims, 5 Drawing Sheets

METHOD AND APPARATUS FOR FORMING TONER IMAGES WITH TWO DISTINCT TONERS

This invention relates to the formation of toner images and, more specifically, to the formation of toner images of two distinct toners, for example, toners of two different colors.

U.S. Pat. No. 5,001,028 to Mosehauer et al, issued Mar. 19, 1991, is representative of a large number of patents which show the creation of multicolor toner images by creating two unfixed toner images on a single frame of a photoconductive image member. Color printers have been marketed using this general approach, employing discharged area development (DAD) and electronic exposure for each image.

A few references suggest a mixture of discharged area development and charged area development (DAD and CAD). For example, see U.S. Pat. No. 5,045,893 to Tabb, granted Sep. 3, 1991, in which the first toner image is made with DAD, the image member is recharged and re-exposed with the second image made with CAD. See also in this respect, U.S. Pat. Nos. 5,208,636; 5,241,356; 5,049,949; and 5,258,820.

In the above processes in which DAD and CAD images are mixed, the resulting two color image contains toner of opposite polarities. In this respect it is similar to a process called tri-level xerography. Tri-level xerography, as shown in U.S. Pat. No. 4,078,929 to Gundlach, uses a single exposure having three discrete voltage levels. The high and low level voltages are toned with opposite polarity toners with the middle voltage remaining untoned and thereby making up the background of the final image.

A two color toner image having opposite polarity toners must be treated to change the sign of one of the toners before it can be electrostatically transferred. Typically, this is done by application of a corona which may be combined with exposure by an erase lamp.

"Scavenging" of first image toner into the second station is a well documented problem, especially of DAD-DAD imaging. Many prior references suggest projection toning for applying toner to second and subsequent images in DAD-DAD processes. This greatly reduces scavenging of the first image into the second toning station, but it greatly reduces the speed at which the second image can be toned to full density. U.S. Pat. No. 5,409,791 to Kaukeinen et al, issued Apr. 25, 1995, suggests that the use of high coercivity carrier, similar to that used in the Mosehauer reference but with projection toning and an AC field, can maintain both the reduced scavenging while still toning at high speed, albeit not necessarily as high as the contact toning from the Mosehauer et al application.

U.S. Pat. No. 4,761,668, issued Aug. 2, 1988, to Parker et al., suggests that toner can be attracted out of a second station and into an interframe in a tri-level system to purge the second station of scavenged first image toner.

Although projection toning reduces scavenging to tolerable limits and the use of the Kaukeinen invention provides improved density at high speed compared to prior projection systems, performance of projection toning is heavily dependent upon accurate spacing between a toning applicator and the electrostatic image carrying image member. Such spacing has been found quite difficult to maintain in practice and, in fact, is accomplishable only by putting more complexity and expense into the components themselves.

SUMMARY OF THE INVENTION

We have found that the use of a DAD-CAD system can reduce scavenging even though the second image is toned with a contact nonprojection system. However, some scavenging still occurs even in a DAD-CAD system.

It is an object of the invention to reduce scavenging in DAD-CAD or CAD-DAD systems.

In a DAD-CAD system, an image member is charged to a first polarity and exposed to create an electrostatic image. The electrostatic image is developed with toner also charged to the first polarity (DAD). The image member is preferably not recharged but is exposed to create a second electrostatic image, still of the first polarity. This image is toned with a toner of a second polarity opposite the first. This process is reversed for a CAD-DAD system.

According to one aspect of the invention, we have extended the life of the second developer by allowing the deposit of first toner in the background of images intended to be toned only in the second color and by adjusting the transfer field to transfer only the second toner, allowing the first toner to continue with the image member and be cleaned at a cleaning station.

According to another aspect of the invention, a discharged image member can be moved through the second toning station with the bias set on the second toning station to tone it with scavenged toner. The transfer station is adjusted to not transfer this toner, and the scavenged toner is cleaned off in the cleaning station.

With both of these approaches, toner from a first station which is scavenged into a second station can be pulled from the station, thereby extending the life of the developer in the second station.

DETAILED DESCRIPTION OF THE INVENTION

FIGS. 1–7 illustrate a DAD-CAD method (sometimes herein called a "submethod") of forming a two color toner image. According to FIG. 1, an image member 1 includes an image side 2 and an opposite or base side 4. Preferably, the image member 1 is transparent. For example, it can be a belt or web image member having a polyester or other suitable transparent support well known and used in the art. Such image members include a transparent conductive layer on the image side 2 upon which is coated suitable photoconductive layers to make the image member 1 photoconductive. The conductive layer and photoconductive layers are extremely thin and are not shown in the FIGS. The image member could also be a glass drum with similar layers coated thereon.

The method will be described with respect to a negative charging image member. It will be clear to those skilled in the art that a positive charging image member could also be used.

Figure 1:
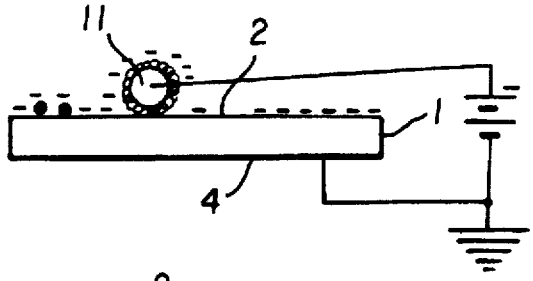
FIGS. 1–7 show seven steps in a method for forming a two color image.
Figure 2:
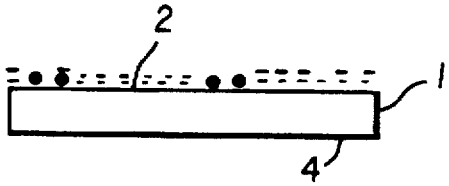

The image member is uniformly charged to a negative potential. It is imagewise exposed to create a negative electrostatic image and, as shown in FIG. 1, a negative toner is applied to it in the presence of an electric field which encourages deposition of the negative toner according to the amount of discharge of the electrostatic image. That is, the toner shown in FIG. 1 adheres to areas of lowest potential in the electrostatic image, creating a first toner image, as shown in FIG. 2, created by a DAD process.

Figure 3:
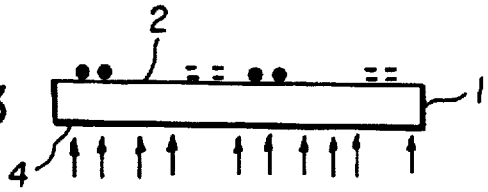

According to FIG. 3, the image member is exposed through its base 4 (preferably without recharging) to create a second electrostatic image. It is important that this exposure be conducted through the base in order to discharge the charge underneath the first toner image below that of exposed areas surrounding the first toner image. If this charge is not dissipated, the negatively charged first toner has a tendency to be pushed by that charge into the areas adjacent it that have been equally or more discharged, thereby reducing the sharpness and resolution of the first toner image. With exposure through the base, we have been able to reduce the charge underneath the first toner image to 50–100 volts below that of areas surrounding the image that are also exposed. This allows the adjacent negative charge to hold the negative toner of the first image in place.

Figure 4:
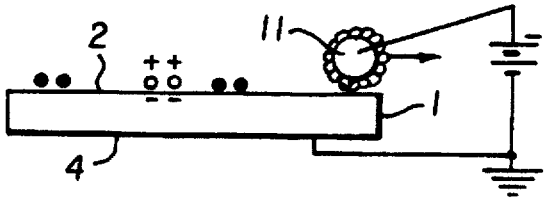

According to FIG. 4, the second electrostatic image is toned using a CAD toning process. More specifically, a magnetic brush 11 containing positive toner applies toner to image member 1 in the presence of an electric field that encourages deposition of toner on the high potential portions of the second electrostatic image. Typically, in CAD development, the electric field is biased so that magnetic brush 11 is slightly more negative than the exposed portion of the second electrostatic image to inhibit development of the nonimage areas in the second electrostatic image. This bias also inhibits pickup of negative toner from the first image.

Figure 6:
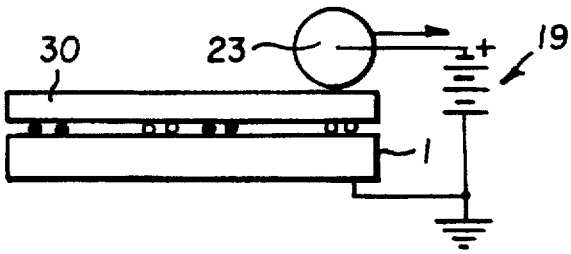
Figure 7:
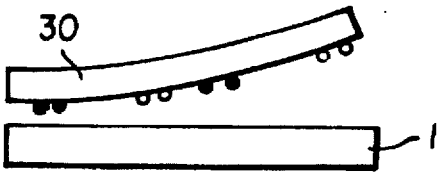

The two color toner image, shown in FIG. 4, contains both negatively charged and positively charged toner. For electrostatic transfer, the image is treated so that it responds more uniformly in an electrical field. According to FIG. 5, this is accomplished by using a negatively biased corona charger 15 which sprays negative charges on the image side of the image member 1. As is well known in the art, the charger 15 can be assisted by an erase lamp 17 which, with a transparent image member 1, can be positioned on the opposite or base side of the image member 1. As shown in FIGS. 6 and 7, the two color image is transferred to a receiving sheet 30 in the presence of an electric field created by a bias supplied from a source of potential 19 to a transfer backing member or roller 23. The receiving sheet 30 is separated from the image member 1, as shown in FIG. 7, with the two color image attached.

The use of CAD developing with opposite polarity toner for the second image greatly reduces the tendency of first toner to scavenge into the second station or for the second toner to overtone the first toner image. This permits the use of contact developing rather than projection developing with its increased density at high speed and greatly reduced sensitivity to spacing.

The reduced scavenging effect is optimized by the use of a brash similar to that shown in the Mosehauer patent. This brash will be discussed in more detail with respect to FIG. 20. It has a very soft nap which reduces the tendency of the brash to scrape off the first image and also provides extremely high density development at high speed with a relatively small development station.

Early resolution problems we encountered were caused by movement of toner in the first image in response to the second exposure step. This movement is due to residual charge of a negative polarity underneath the first toner which pushes the particles into the background of the second image which has less remaining charge after the second exposure. This problem has been virtually eliminated by exposing the second image through the base, as shown in FIG. 3 and as explained above.

Any toner from the first image that has a tendency to be scavenged into the second toning station is likely to be deposited in the background of subsequent images, assuming it has maintained its original charge. The life of the developer in the second station is dependent upon the extent of this scavenging. The point at which a noticeable mount of the first, negative toner from the first image appears in the background of the second image is the point at which the developer must be changed in the second station. Because of the polarities of the toners in the DAD-CAD process, shown in FIGS. 1–7, and the softness of the development brush, shown in FIG. 20, this effect is quite small, and the life of the developer is relatively long. However, we have found two submethods which can prolong the life of the second developer even further.

Figure 8:
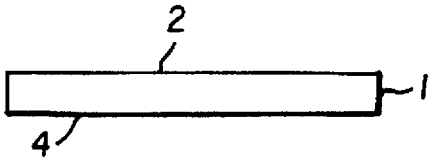
FIGS. 8–14 show a submethod variation on the method shown in FIGS. 1–7.
Figure 9:
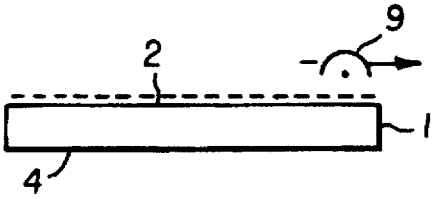
Figure 10:
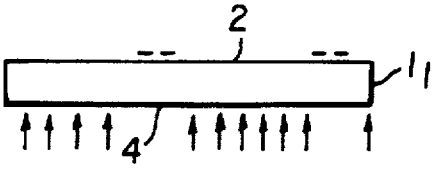

The first submethod is illustrated in FIGS. 8–14. These FIGS. show a method in which there is a demand for second color only images. That is, if the color of the first toner image is black and the color of the second toner image is red in the process shown in FIGS. 1–7, the same apparatus will, from time to time, be asked to make only red images for one or more runs. Image member 1 is shown in FIG. 8 without any charge on it as it enters the process. According to FIG. 9, it is charged to a negative polarity by the same charging device 9 used to form the first electrostatic image in FIG. 1. According to FIG. 10, the image member 1 is imagewise exposed to create a negative electrostatic image, and according to FIG. 11, that electrostatic image is toned by application of positive toner from magnetic brush 11.

Magnetic brush 11 has been operating for many images without changing the developer and contains some negatively charged toner that had been scavenged from first, black images in earlier two-color image forming runs. Some of these negatively charged black toner particles have a tendency to deposit in the background portions of the electrostatic image, as shown in FIG. 11.

Figure 5:
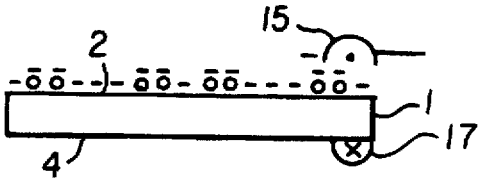
Figure 11:
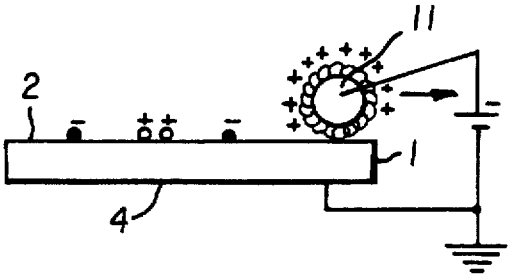
Figure 12:
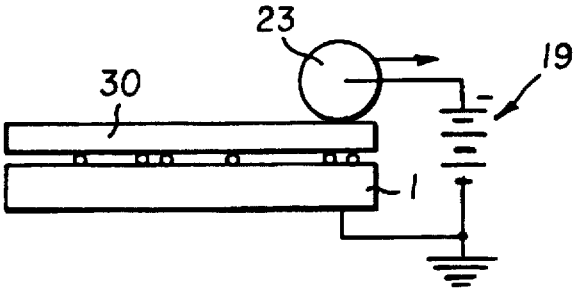
Figure 13:
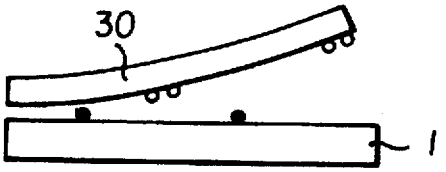
Figure 14:
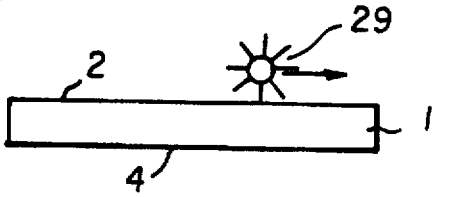
Figure 15:
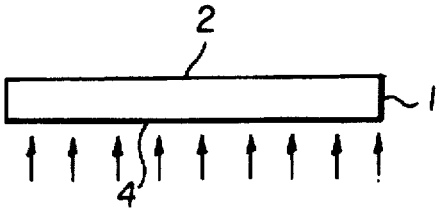
FIGS. 15–18 show a four step submethod which is a variation to the submethod shown in FIGS. 8–14.

However, for the submethod shown in FIGS. 8–14 where only red images are desired, the treatment step shown in FIG. 5 is eliminated and the red image with some black toner particles in its background is fed into the transfer station, as shown in FIG. 12. However, the transfer field is reversed in FIG. 12 from that shown in FIG. 6 to encourage the transfer of untreated positively charged (red) toner particles while inhibiting the transfer of negatively charged (black) toner particles. Thus, as shown in FIG. 13, the receiving sheet 30 is separated from image member 1 with the red toner image adhering to receiving sheet 30 and the black toner adhering to image member 1. As shown in FIG. 14, the black toner is cleaned off image member 1 by a cleaning device 29 at a cleaning station so that the image member 1 can be reused.

The submethod shown in FIGS. 8–14 provides background-free copy with an old developer while actually getting rid of some of the contamination of magnetic brush 11. An extended single color run of this nature would have a cleansing effect on the second development station, thereby prolonging the life of its developer.

Figure 16:
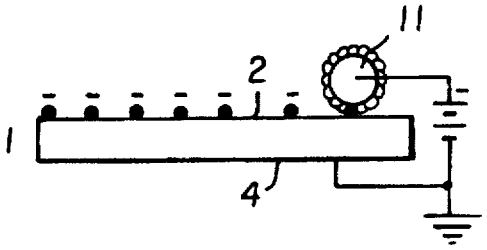
Figure 17:
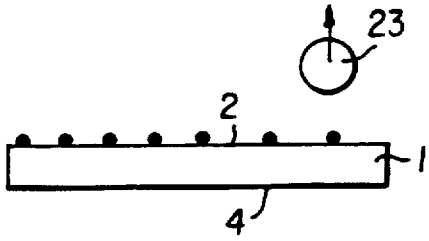
Figure 18:
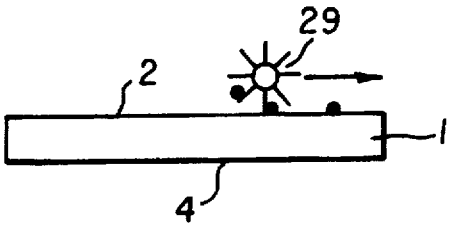

FIGS. 15–18 illustrate use of a similar submethod to that shown in FIGS. 8–14 to clean the second development station without actually making images. According to FIG. 15, the image member is discharged by some means, for example, the same exposure means that forms the electrostatic image in FIGS. 3 and 10. According to FIG. 16, is the magnetic brush 11 is allowed to attempt to tone the discharged image member 1 in the presence of a field urging the application of negative toner to image member 1 while discouraging the application of any positive toner. This field is shown in FIG. 16 as having a somewhat stronger negative bias on toning station 11 than is used for development (FIGS. 4 and 11). The treating step shown in FIG. 5 can be again eliminated. The transfer step, shown in FIG. 6, is also eliminated. No receiving sheet need be fed. As shown in FIG. 17, transfer backing member 23 is articulated away from image member 1. Transfer to the backing member 23 can also be prevented by adjusting the bias on transfer backing member 23 as is done in FIG. 12. If electrostatic transfer is accomplished by a corona, the corona need only be turned off. The negative (black) toner on image member 1 is then cleaned off by cleaning device 29, as shown in FIG. 18.

The submethod shown in FIGS. 15–18 can be employed any time the apparatus is otherwise not in use, for example, it can be routinely used while the apparatus is warming up, since the routine does not require use of a fuser which may require the longest warmup time.

Figure 19:
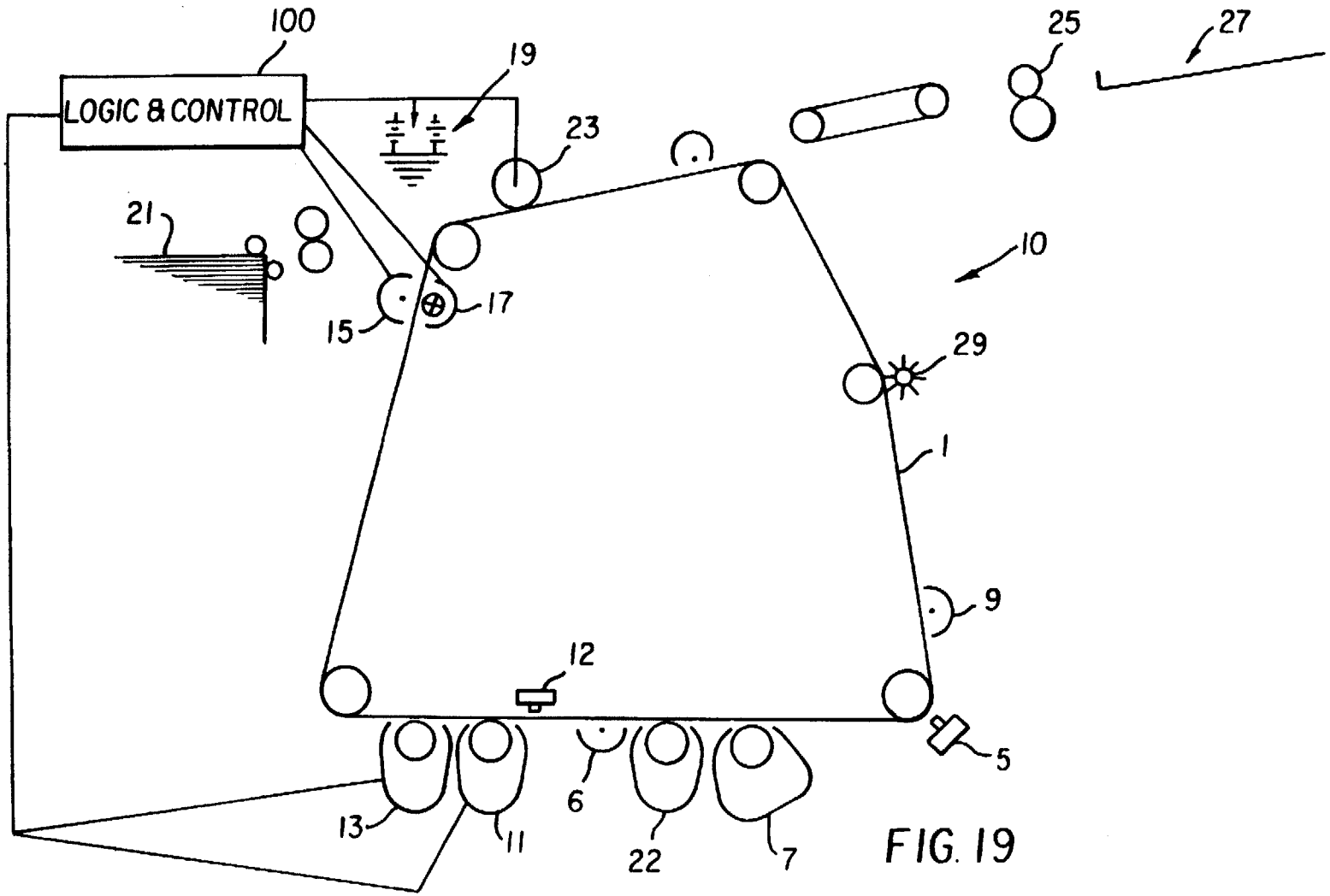
FIG. 19 is a side schematic of an image forming apparatus.

FIG. 19 shows an image forming apparatus 10 for carrying out all three submethods shown in FIGS. 1–18. According to FIG. 19, an image member 1 in the form of a transparent photoconductive belt is trained about a series of rollers for movement through a path past a series of stations. Image member 1 is uniformly charged by a charging station 9 and imagewise exposed at a first exposure station, for example, an LED printhead 5, a laser, or the like, to form a first electrostatic image. The first electrostatic image is of a first polarity as determined by the charge from charging station 9.

A first toner of a first color and a first polarity (for example, negative black toner) is applied to the first electrostatic image by a suitable toning station 7 to form a first toner image. Because the toner is negative in polarity, it adheres most densely to the most discharged portions of the first electrostatic image (DAD development).

The image member with the first toner image can be recharged by a charging station 6, again, to a negative potential (a step that may well not be necessary). Whether recharged or not, it is imagewise exposed by a second exposure station, for example, an LED printhead 12, laser, or the like, positioned behind image member 1 to create a second electrostatic image. This electrostatic image is toned by the application of positively charged toner of a second color (for example, red) from the previously shown second toning station 11. Alternatively, the second electrostatic image can be toned by application of positively charged toner of a third color, for example, yellow, from a third toning station 13.

Preferably, both toning stations 11 and 13 are constructed, as will be described with respect to FIG. 20, to provide a soft magnetic brush having a tendency to cause little disturbance to the first toner image and providing extremely high density at high speed with a relatively small station.

If the colors of the toners in toning stations 7 and 11 (or 13) are of different color, image member 1 now has a two color image. Obviously, the toners in stations 7 and 11 could be of the same color but different characteristics. For example, one of the two toners could be a black magnetic toner and the other a black non-magnetic toner, which arrangement would have certain advantages in certain processes. For purposes herein, such a combination of non-magnetic and magnetic black toners is essentially the same as a two color toner image.

The two color toner image proceeds to a treatment station made up of a corona charger 15 and an erase lamp 17. Corona charger 15 is biased to change the polarity of one of the toners making up the two color toner image. For example, it may apply a negative charge to the two color image, thereby changing the charge on the positive toner particles applied at either toning station 11 or toning station 13. As is well known in the art, this process can be assisted by use of an erase lamp 17 positioned at and/or before the corona charger 15 which further reduces the affinity of the toner for image member 1.

The treated two color image proceeds to the transfer station, including a transfer backing roller 23, .where a potential is applied from a reversible potential source 19, encouraging transfer of the toner from a receiving sheet fed from a receiving sheet supply 21.

The receiving sheet is separated from image member 1 as image member 1 passes around a small roller and is transported to a fuser 25 and eventually into an output tray 27. Cleaning station 29 cleans the image member 1 so that it can continue to be used in the process.

The above description describes operation of image forming apparatus 10 in carrying out the submethod described with respect to FIGS. 1–7. In carrying out the submethod described in FIGS. 8–14, exposing LED printhead 5 and toning station 7 are turned off while single color images are made using charging station 9, exposing LED printhead 12 and either of toning stations 11 or 13. Corona device 15 and erase lamp 17 are also turned off, and the bias applied from reversible voltage supply 19 to backing roller 23 is reversed so that the red or yellow toner applied by stations 11 and 13, in fact, transfers to the receiving sheet, while any black toner contained in either of those stations that is deposited in the background continues on on image member 1 to be cleaned off by cleaning device 29.

The submethod described with respect to FIGS. 15–18 is carried out by the image forming apparatus 10, for example, during cycle-up of the apparatus 10 when it is initially turned on for the day. During such cycle-up, while the fuser 25 is warming up, the image member 1 is driven through its endless path. LED printhead 12 and either or both of toning stations 11 and 13 are turned on. LED printhead 12 fully erases any charge on image member 1 and bias is applied to stations 11 and 13 which encourages the deposition of any black toner remaining in those stations onto image member 1. The black toner, being negative in polarity, is repelled by a strong negative bias on toning stations 11 and 13. Again, corona 15 and erase lamp 17 are turned off and transfer backing member 23 is articulated away from image member 1 to allow the black toner on image member 1 to continue to the cleaning device 29. Obviously, no sheet is fed from receiving sheet supply 21 for this portion of the operation. As mentioned above, backing member 23 can be maintained in place but biased to prevent the transfer of toner to it.

Operation of the image forming apparatus 10 is controlled by logic and control 100 which turns on and off all of the subsystems in appropriate timing, as is well known in the art. As shown in FIG. 19, it especially controls the bias applied to transfer backing roller 23 and the actuation of corona 15 and erase lamp 17 for working of the submethods shown in FIGS. 8–18. It also controls the bias on the development stations, including the bias applied to stations 11 and 13 during the subprocess shown in FIGS. 15–18.

Another toning station 22 is shown in FIG. 19. This station could be used to provide a second primary color alternative to that supplied by station 7 for the DAD image. However, it can be used for a different purpose to further prevent scavenging of toner applied by station 7. More specifically, for this purpose, station 22 contains clear toner of the same polarity as the toner in station 7 (negative, in the example). This station 22 is biased to apply a light topping of clear toner to the first toner image created by stations 9, 5 and 7. This toner does not affect the density of the image because it is clear. However, if any toner is scavenged from the image by stations 11 or 13, it is likely to be the toner on top, i.e., the clear toner supplied by station 22. Eventually, some toner from station 7, for example, black toner, will be scavenged by station 22 since they are of both the same polarity.

The use of the clear toning station 22 greatly prolongs the life of the developers in stations 11 and 13. However, the use of the clear toner also has another advantage. Gradual scavenging of black toner into the clear station is quite obvious and can be readily measured by either measuring light reflected or transmitted through toner in station 22. This allows a monitor of the scavenging effect of the system which, properly calibrated, can give the operator an indication when the developers in stations 11, 13 and 22 should be changed.

This feature associated with the use of clear toner in station 22 is shown with respect to a DAD-CAD process. In fact, it is particularly useful in any process in which an electrostatic image is toned in the presence of an unfixed toner image of any polarity. Note that, because the station 22 involves DAD development, scavenging into it is more likely than it is into stations 11 and 13, both of which are shown to be CAD stations in FIG. 19. Thus, projection toning is preferred in station 22.

Figure 20:
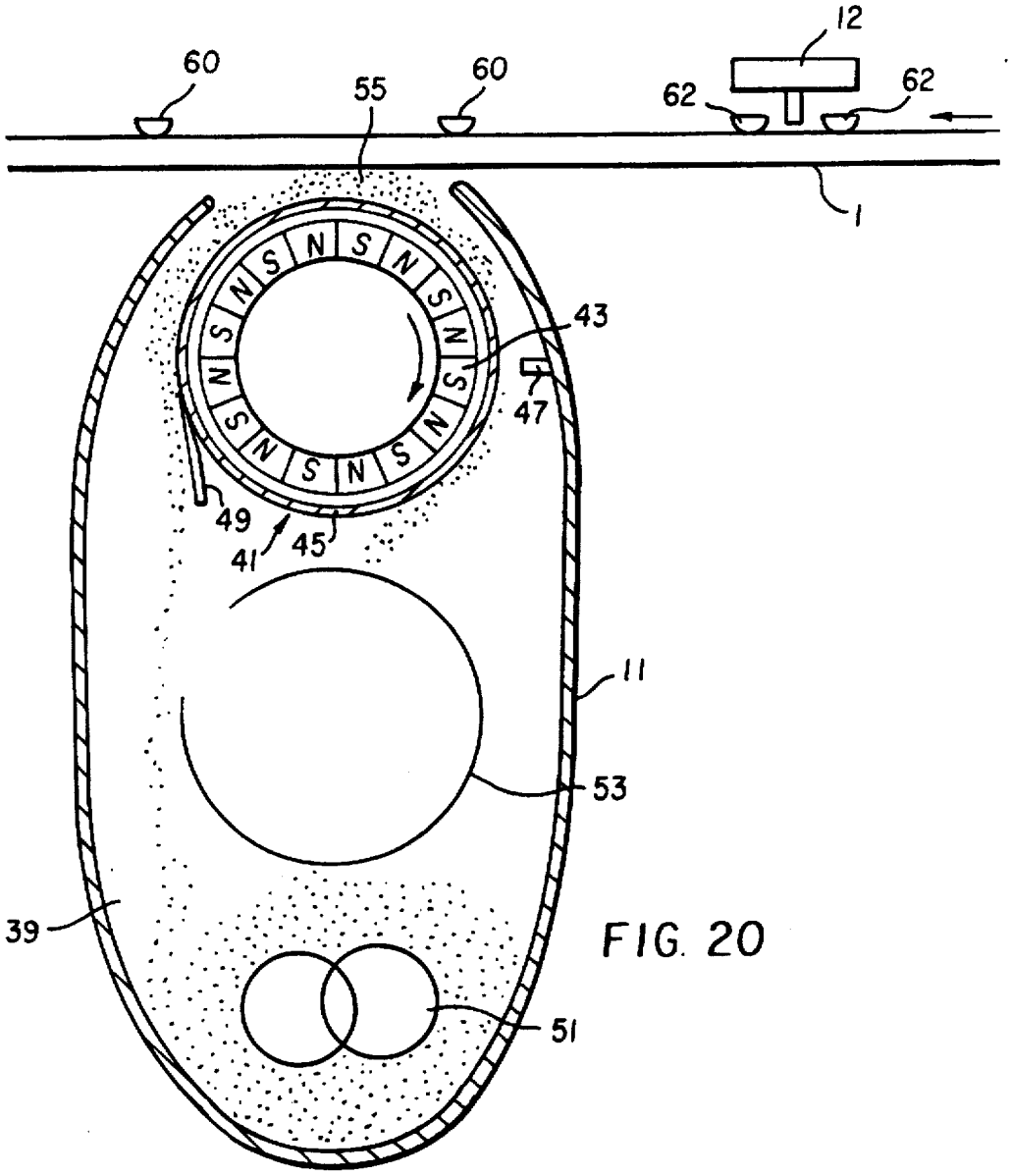
FIG. 20 is a side schematic of a development station.

FIG. 20 shows in detail a preferred embodiment of toning station 11 (and also station 13). Toning station 11, as shown in FIG. 20, embodies technology first disclosed in U.S. Pat. No. 4,546,060, Miskinis et al, issued Oct. 8, 1985, and further described in U.S. Pat. No. 5,001,028 to Mosehauer et al (cited above), both of which patents are hereby incorporated by reference herein. Toning station 11 includes a housing which defines a sump 39 in which a supply of developer is mixed by suitable mixing augers 51. The developer includes "hard" magnetic carrier having a coercivity of at least 300 gauss, preferably in excess of 800 gauss, when magnetically saturated. The carrier exhibits an induced magnetic moment of at least 20 EMU per gram of carrier when in an applied field of 1,000 gauss. The toner is a typical insulative toner and is mixed thoroughly with the carrier (the combination generally being termed a "developer").

The developer is transported from sump 39 by a suitable transport device 53 to an applicator 41 for application to an electrostatic image carded by image member 1. Transport device 53 can include a valving feature, well known in the art, which can turn off the station by curing off the supply of developer to applicator 41. Applicator 41 includes a rotatable magnetic core 43 positioned inside an also rotatable non-magnetic sleeve or shell 45. Although the core and shell can be rotated in either direction, most commercial embodiments rotate the core 43 at speeds of 1,000 revolutions per minute or higher in a clockwise direction to move the developer in a counter-clockwise direction around shell 45. If shell 45 is moved in a counter-clockwise direction, it also assists in the flow of developer. Alternatively, the developer can be driven in its counter-clockwise direction primarily by rotation of sleeve 45, and core 43 can also be rotated in a counter-clockwise direction. In this last case, the rotation of the core has primarily a mixing function as it actually encourages movement of the developer against the counter-clockwise direction that the developer is driven by the shell 45.

The rapidly rotating core causes rapid pole transitions on the surface of shell 45 which cause the high coercivity carrier to flip rapidly, usually in strings of carrier, as the developer moves through a development zone 55 between applicator 41 and image member 1. The flipping action moves the carrier from the shell to the image member and back rapidly, replacing lost charge and toner. This device and process have been in use for some years and provide highest quality development with a very soft magnetic brush. The softness of this brush was pointed out in the Mosehauer patent as useful in developing an electrostatic image on an image already carrying an unfixed toner image of a different color. The height of the developer nap is controlled, in part, by a skive 47, and the developer itself is skived off the sleeve 45 by another skive 49 so it can fall back into the sump 39 where it is mixed. The developer station itself is mounted opposite a pair of skis 60 which control the position of image member 1 with respect to applicator 41. Similarly, printhead 12 also includes one or two skis 62 which control the location of image member 1 with respect to it.

Although the core 43 and shell 45 are shown to have the same axis of rotation, some high quality commercial embodiments offset the core and shell axes. This strengthens the magnetic field in the development zone 55 and weakens it opposite the development zone where developer is returned to the sump 39. This construction works especially well when the developer is being moved entirely by shell movement and the core is only mixing, since the skive 49 is relatively ineffective in such an embodiment.

The development station 11, as shown in FIG. 20, provides the highest quality of development available and accomplishes this with very high density at a very high toning speed. Because of the pole transitions and flipping of the strings of carrier themselves, this density and speed can be accomplished with a station of extremely modest size. When the softness of this brush is combined with the scavenging suppressing field associated with CAD developing, remarkably little scavenging occurs.

The invention has been described in detail with particular reference to a preferred embodiment thereof, but it will be understood that variations and modifications can be effected within the spirit and scope of the invention as described hereinabove and as defined in the appended claims.

We claim:

1. An image forming method for use in an apparatus which forms a two toner image by a first submethod including:

forming a first electrostatic image of a first polarity on an image member;

applying a first toner to the electrostatic image to form a first toner image on the image member;

imagewise exposing the image member to form a second electrostatic image in registration with the first toner image;

applying a second toner to the second electrostatic image to form a second toner image in registration with the first toner image; one of the toner images being made up of toner of the first polarity and the other toner image being made up of toner of a second polarity opposite the first polarity;

treating the two toner images to make the toners substantially of one polarity; and transferring the two toner images to a receiving surface by application of an electrical field of a first direction which urges transfer of toner of the one polarity toward the receiving surface to form the two toner image;

said method forming a single toner image by a second submethod including the following steps;

determining that a single toner image is to be made in a toner of a polarity opposite the one polarity;

forming the single toner image using the steps of the first submethod applicable to formation of that toner image except that the treating step is eliminated and the transferring step includes application of an electrical field of a second direction, opposite the first direction, urging transfer of the untreated single toner image to a receiving surface.

2. Image forming method according to claim 1 wherein said treating step applies a charge to the two toner images that is the same as a charge on the first toner.

3. Image forming method according to claim 2 wherein the first toner is of the first polarity.

4. Image forming method according to clam 2 wherein the first and second toners are of different color and the two toner image is a two color toner image.

5. An image forming method for use in an apparatus which forms a two toner image by a first submethod including:

forming a first electrostatic image of a first polarity on an image member;

applying a first toner to the electrostatic image to form a first toner image on the image member;

imagewise exposing the image member to form a second electrostatic image in registration with the first toner image;

applying a second toner to the second electrostatic image to form a second toner image in registration with the first toner image, said applying a second toner step including moving a developer containing said second toner into contact with the image member with presence of an electrical field urging toning of the second electrostatic image, one of the toner images being made up of toner of the first polarity and the other toner image being made up of toner of a second polarity opposite the first polarity;

treating the two toner images to make the toner substantially of one polarity; and transferring the two toner images to a receiving surface at a transfer station by application of an electrical field of a first direction which urges transfer of toner of the one polarity toward the receiving surface to form the two toner image;

said method being characterized by a second submethod including the following steps to be carded out when no images are to be made:

moving said developer into contact with the image member with presence of an electric field urging deposit on the image member of any of the first toner that is mixed in said developer;

allowing any such deposited first toner to pass through the transfer station and remain on the image member; and cleaning such deposited toner off the image member.

6. An image forming method for use in an apparatus which forms a two toner image by a first submethod including:

forming a first electrostatic image of a first polarity on a photoconductive image member;

applying a first toner of the first polarity to the electrostatic image to form a first toner image on the photoconductive image member;

imagewise exposing the image member to form a second electrostatic image in registration with the first toner image;

applying a second toner of a second polarity opposite the first polarity to the second electrostatic image to form a second toner image in registration with the first toner image to form a two toner image which two toner image contains toner of both the first and second polarities, said applying a second toner step including contacting the image member with a developer containing said second toner with presence of an electrical field urging toning of the second electrostatic image, treating the two toner image to make the toner substantially of one polarity; and transferring the two toner image to a receiving surface by application of an electrical field of a first direction which urges transfer of toner of the one polarity toward the receiving surface;

said method being characterized by a second submethod to be carried out when no image formation is desired, to remove first toner that has been scavenged into the developer:

eliminating charge on the image member;

contacting the uncharged image member with said developer with presence of an electric field urging such scavenged toner to deposit on the image member but preventing deposit of the second toner on the image member; and cleaning said scavenged toner off the image member.

7. An image forming apparatus comprising:

means for forming a two color toner image made up of two toner images of different color and opposite polarities, said means including a first toning station and a second toning station, said first toning station containing toner of a first polarity and said second toning station containing toner of a second polarity, said second toning station being positioned to apply toner to an electrostatic image on the image member after formation of a first toner image by the first toning station, where there is a tendency to scavenge toner applied by the first toning station into the second toning station;

means for treating the two color toner image to make the toner substantially of one polarity; and transfer means for transferring the two color toner image to a receiving sheet with presence of an electric field urging transfer of toner of said one polarity;

said apparatus being characterized by means for passing the image member through the second toning station with presence of an electric field urging deposit on the image member of toner of the first polarity present in the second toning station, means for disabling the transfer means to permit such deposited toner of the first polarity to pass through the transfer means on the image member; and means for cleaning such toner of the first polarity off the image member.

8. In a process in which a combined toner image of two single toner images of opposite first and second polarities are formed in a frame of an image member, the combined toner image is treated in a treating step so as to as much as possible eliminate charge of the second polarity and the combined toner image is transferred to a receiving surface with presence of an electrical field urging transfer of toner of the first polarity, in which process one of the toner images is formed by applying a first toner to an electrostatic image with presence of a second toner of the other toner image using a toner applying station that tends to scavenge some of the second toner from the other toner image into the toner applying station;

a subprocess for removing scavenged second toner from the other toner image from the toner applying station when making single toner images only with the first toner from the toner applying station which includes applying the first toner from the toner applying station to an electrostatic image with presence of an electrical field urging application of the first toner in image areas of the electrostatic image and scavenged second toner in background areas of the electrostatic image, eliminating the treating step and transferring the toner image to a receiving surface with presence of an electrical field having a tendency to transfer the first toner but leave the scavenged second toner on the image member.

* * * * *